United States Patent [19]

Lorenz

[11] Patent Number: 4,623,072

[45] Date of Patent: Nov. 18, 1986

[54] CORRUGATED CONTAINER WITH FOLDABLE FLAPS

[75] Inventor: Achim R. Lorenz, Marietta, Ga.

[73] Assignee: MacMillan Bloedel Limited, Vancouver, Canada

[21] Appl. No.: 724,470

[22] Filed: Apr. 18, 1985

[51] Int. Cl.[4] ..... B65D 90/04

[52] U.S. Cl. ..... 220/443; 220/416; 220/441; 229/DIG. 2; 229/DIG. 4; 493/175; 493/177; 493/363; 493/906

[58] Field of Search ..... 229/37 R, DIG. 2, DIG. 4, 229/48 R, 4.5; 220/416, 441, 443, 468; 493/56, 163, 175, 177, 363, 364, 463, 906

[56] References Cited

U.S. PATENT DOCUMENTS

| | | | |
|---|---|---|---|
| 1,097,390 | 5/1914 | Corwin | 229/DIG. 2 |
| 1,987,461 | 1/1935 | Boeye | 220/441 |
| 2,075,679 | 3/1937 | Weber | 93/45 |
| 2,139,845 | 12/1938 | Neely | 229/DIG. 4 |
| 2,176,284 | 10/1939 | Whiteford | 229/DIG. 2 |
| 2,291,542 | 7/1942 | Filler | 229/DIG. 4 |
| 2,893,436 | 7/1959 | Mann | 229/DIG. 2 |
| 2,954,913 | 10/1960 | Rossman | 220/441 |
| 3,199,763 | 8/1965 | Anderson | 229/DIG. 4 |
| 3,300,355 | 1/1967 | Adams | 156/189 |
| 3,654,842 | 4/1972 | Schwenk | 93/94 PS |
| 3,732,790 | 5/1973 | Miyake | 93/94 R |
| 3,838,632 | 10/1974 | Miyake | 93/94 PS |
| 3,910,485 | 10/1975 | Wandel | 220/441 |
| 3,919,925 | 11/1975 | Hayama | 93/94 PS |
| 3,943,030 | 3/1976 | Olsen | 156/446 |
| 4,346,832 | 8/1982 | Werner | 229/4.5 |
| 4,511,078 | 4/1985 | Rauser et al. | 229/17 R |

FOREIGN PATENT DOCUMENTS

| | | | |
|---|---|---|---|
| 928395 | 6/1947 | France | 220/416 |
| 1215270 | 11/1959 | France | 220/452 |
| 471136 | 3/1937 | United Kingdom | 220/441 |

*Primary Examiner*—William Price
*Assistant Examiner*—Gary E. Elkins
*Attorney, Agent, or Firm*—Banner, Birch, McKie & Beckett

[57] ABSTRACT

Multi-layered corrugated containers having at least one flat side, have at least one foldable flap attached at the fold line to the flat side. In the past the fold line has been scored or crushed after the box is formed, and this represents an additional manufacturing step. The container includes a multi-layered sleeve with at least one flap on one end of the sleeve and a fold line separating the flap from the sleeve, the fold line having a strip with no corrugations therein permitting the flap to be bent about the fold line.

8 Claims, 9 Drawing Figures

CORRUGATED CONTAINER WITH FOLDABLE FLAPS

Figure 1:
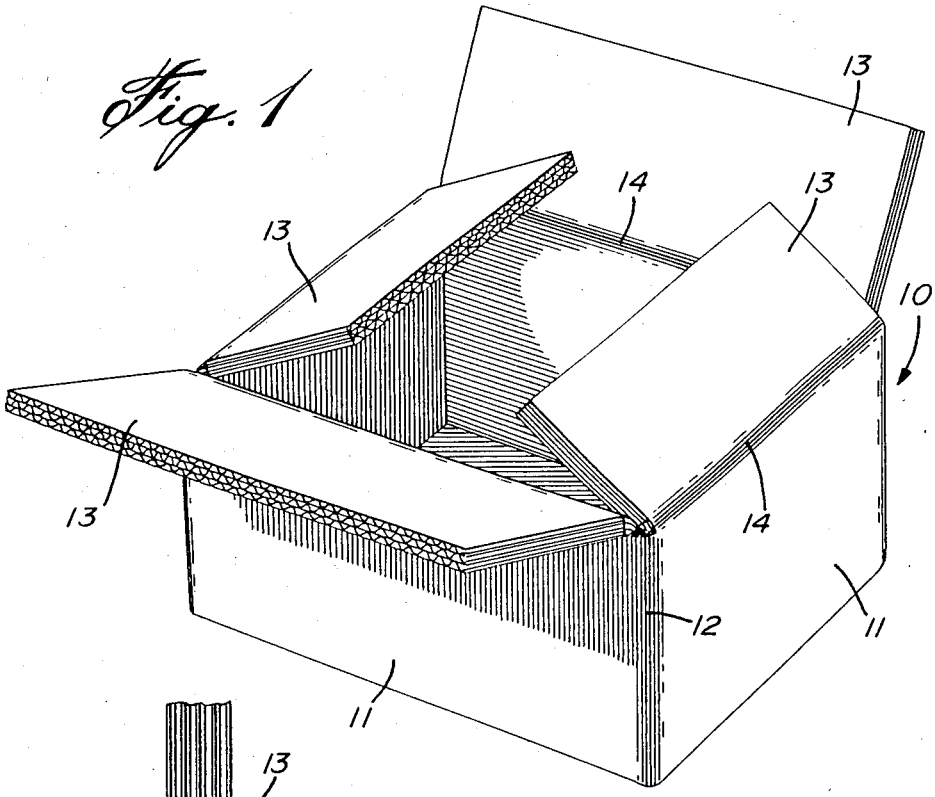

The present invention relates to a multi-layered corrugated container. More specifically, the present invention relates to a multi-layered corrugated container with at least one flat side having a foldable flap attached at a fold line to the flat side.

Multi-layered corrugated containers include boxes, cartons, bulk bins and the like, which are used for packaging, shipping and storing many different articles and products. Corrugated containers are generally made from a flat box blank single layer corrugated board and folded into a container. Double and triple wall boxes are made by glueing two or three corrugated board layers together and then cutting and scoring a box blank from a flat sheet of double or triple wall board. The box blank is then folded into a container with at least one butt or lapp joint at a corner which is either stitched, glued or taped to form the container.

Corrugated board containers may also be made by winding corrugated board layers about a mandrel and glueing the layers together during winding to form a sleeve. Containers made by this method have no butt or lapp joints and therefore use less material than more conventional containers. Multi-layered wound containers are just as strong and in most cases, stronger than those formed with a joint between two panels.

When a box blank is cut from a flat sheet of multi-layered corrugated material, it is possible to cut flaps so that they can be folded to close or partially close one or both ends of the container. It is also possible to make a multi-layered box blank with the flaps having fewer layers than the panels or sides of the box and this enables the flaps to be more easily folded at a fold line. If you have three or more layers of corrugated board, the folding of a flap becomes difficult without specially scoring or crushing the box at a fold line and this represents an additional step in the manufacturing process which entails increased costs.

The present invention provides a novel multi-layered container made from corrugated board having layers of flat sheets laminated to corrugated medium, wherein a strip is provided in the multiple layers with no corrugated medium, to form a fold line for a flap. The resulting flap can be folded without additional scoring or crushing steps. The foldable flaps being multi-layered provided increased strength over single layered flaps.

Whereas flaps with fewer layers may be made in a flat box blank, it is not easy to produce a corrugated board container with a single layer of board in flaps when winding corrugated layers about a mandrel. The present invention provides a method of producing a foldable flap for a flat side of a multi-layered container made by winding corrugated layers about a mandrel.

Previously it has been common for multi-layered containers such as bulk bins, to have a separate cap fitting over at least one end. The present invention permits foldable flaps, either half flaps or full flaps which are formed integral with a multi-layered container.

The present invention provides in a container including a multi-layered sleeve formed of corrugated board layers, the sleeve having at least one flat side, the improvement comprising at least one flap on at least one end of the sleeve, the flap extending from the flat side, a fold line separating the flap from the flat side of the sleeve, the fold line having a strip with no corrugations therein permitting the flap to be bent about the fold line.

In other embodiments each of the corrugated board layers has a flat sheet laminated to corrugated medium and has no corrugated medium in the strip at the fold line prior to forming the corrugated board layer into the multi-layered sleeve. Preferably the strip with no corrugations therein is at least as wide as the thickness of the sleeve.

The present invention also provides in a method of making a corrugated board container wherein a corrugated board layer is wrapped about a mandrel to form a multi-layered sleeve having at least one flat side, the improvement including a flap on at least one end of the flat side of the sleeve comrpising the steps of: feeding a corrugated board layer including a flat sheet laminated to corrugated medium, to be wrapped about the mandrel, leaving a strip of the flat sheet perpendicular to the mandrel axis wherein no corrugated medium is provided, before winding the corrugated board layer about the mandrel, the strip representing a fold line separating the flap from the flat side of the sleeve, such that the flap may be bent about the fold line.

In another embodiment, the present invention provides in a method of making a corrugated board container wherein a corrugated board layer is wrapped about a mandrel to form a multi-layered sleeve having at least four flat sides with corners between adjacent sides, the improvement of including flaps on at least one end of the sleeve comprising the steps of: feeding a corrugated board layer including a flat sheet laminated to corrugated medium, to be wrapped about the mandrel, removing a strip of the corrugated medium from the corrugated board layer, leaving the flat sheet, before winding the corrugated board layer about the mandrel, the strip representing a fold line separating each flap from the flat sides of the sleeve, and cutting flaps at the sleeve corners such that each flap may be bent inwards about the fold line.

In other embodiments of the invention, the method of removing the corrugated medium is by cutting with fine tooth rotary saw blades or with a router. The flaps themselves may be slit at the sleeve corners between the flat sides, or alternatively, the sleeve corners may be sawed off to provide slots between adjacent flaps.

Figure 2:
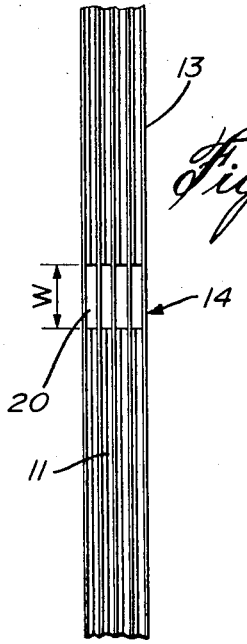
Figure 3:
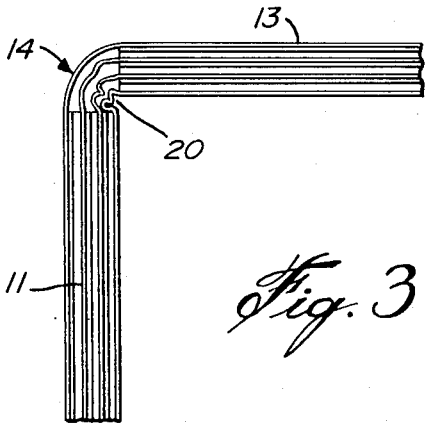
Figure 4:
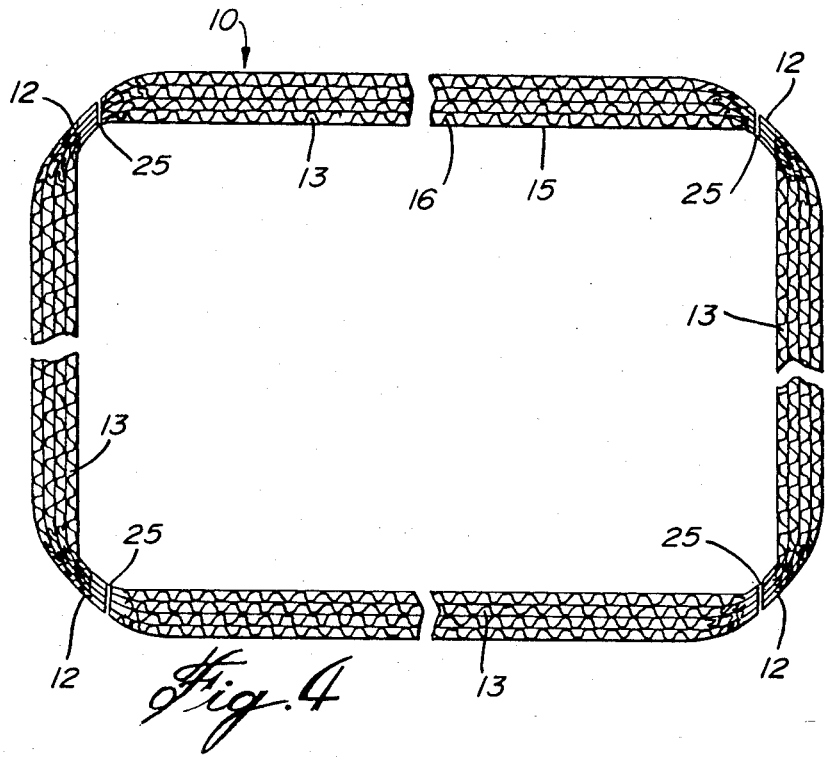
Figure 5:
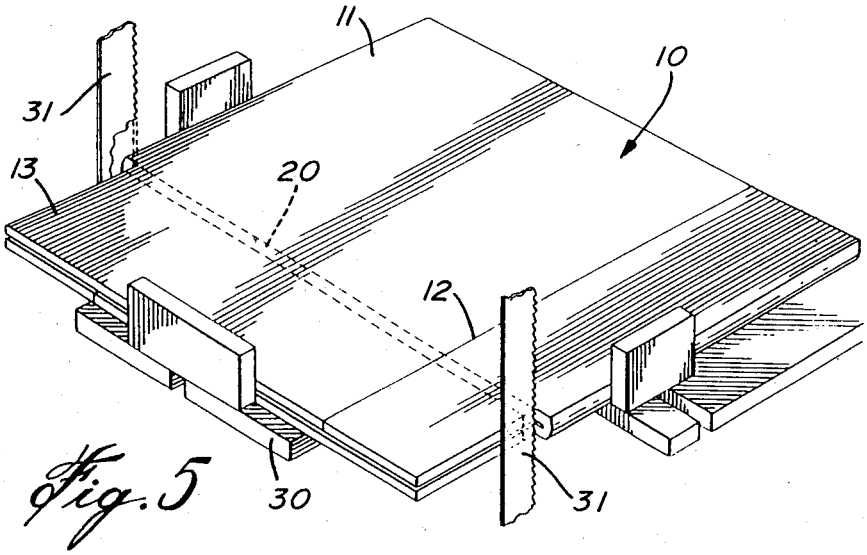
Figure 6:
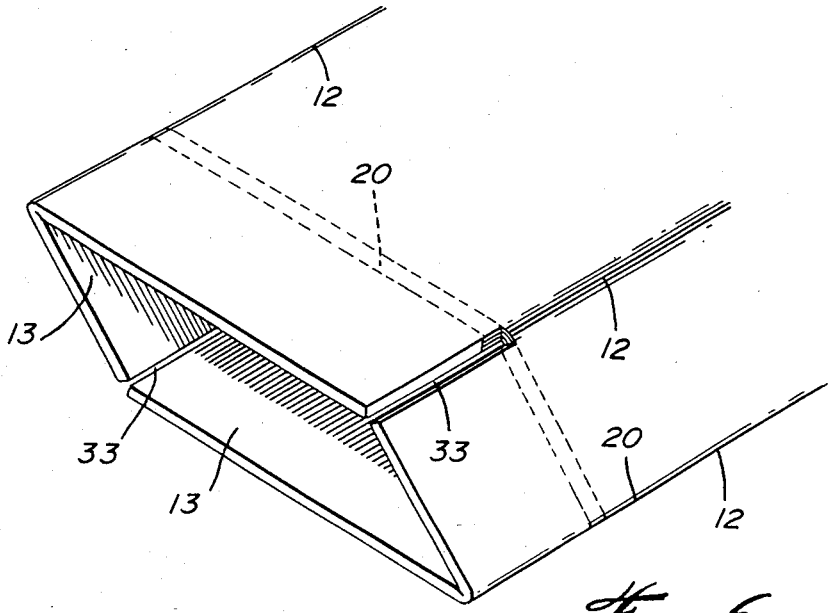
Figure 7:
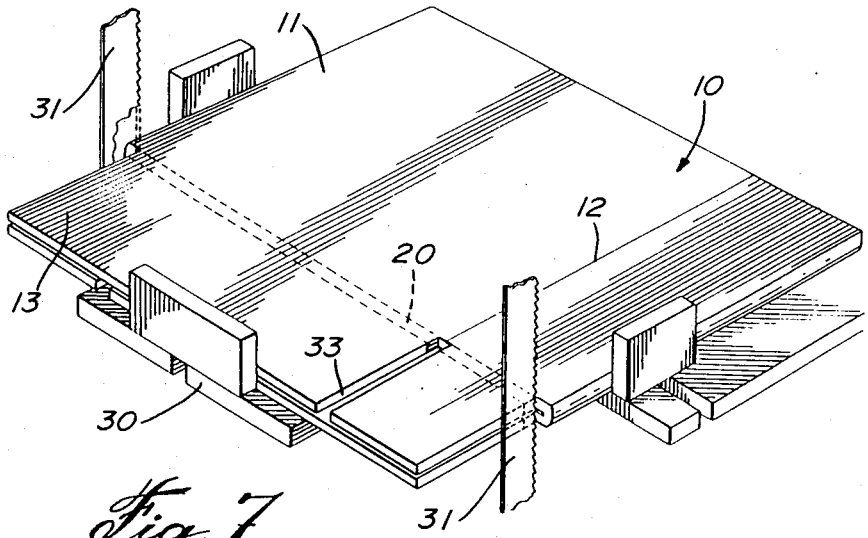
Figure 8:
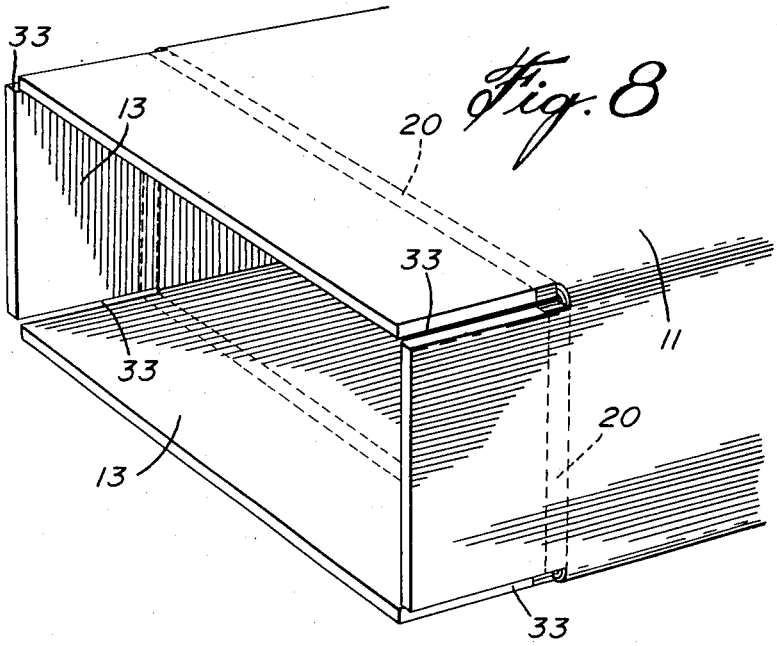
Figure 9:
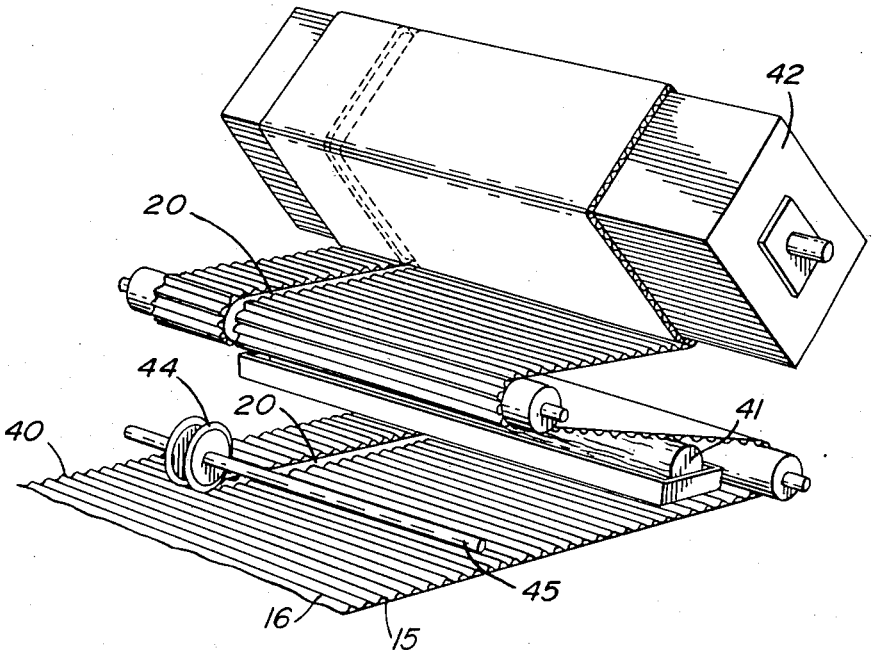

In drawings which illustrate embodiments of the invention,

FIG. 1 is an isometric view of a multi-layered container with foldable flaps, FIG. 2 is a vertical cross section through a panel and an adjacent flap showing a strip of corrugations removed, FIG. 3 is a vertical cross section of the panel and adjacent flap shown in FIG. 2 with the flap folded at right angles, FIG. 4 is a horizontal cross section through a multi-layered container showing slits at the sleeve corners to allow the flaps to be folded inwards, FIG. 5 is an isometric view showing sleeve corner slots being cut on a container folded in a first mode, FIG. 6 is an isometric view of a container partially opened showing two corner slots cut therein, FIG. 7 is an isometric view of the container shown in FIGS. 5 and 6 folded in a second mode and a second series of sleeve corner slots being cut, FIG. 8 is an isometric view showing the container of FIGS. 5, 6 and 7 with slots at all four sleeve corners, FIG. 9 is an isometric view showing the fine tooth saw blades removing a strip of corrugations from a corrugated board prior to wrapping the corrugated board about a mandrel.

One method of forming a multi-layered container from corrugated board is disclosed in U.S. Pat. No. 4,441,948 to Gillard et al which issued Apr. 10, 1984. In this process, a corrugated board layer is wound about a mandrel to form a sleeve and as each corner of the mandrel passes over a shoe plate, the layer of corrugated board is compressed. Another example of a multi-layered container is disclosed in co-pending Canadian patent application Ser. No. 459,774, filed by Gillard on July 26, 1984. This application shows a multi-layered container having crushed and bevelled corners. This latter application discloses a bottom cap fitted at the base of the container and also mentions that a top cap may be provided.

An improvement to the container disclosed in the previous specifications and also to any multi-layered corrugated board container is to form flaps on the container in such a way that they can be used to close or partially close the top and bottom of the container and provide increased strength to that container. FIG. 1 illustrates a container 10 which has side panels 11 with corners 12 beteeen adjacent panels 11. Flaps 13 are provided at the tops of the panels 11 joined thereto by means of a fold line 14. The fold line 14 allows the flaps 13 to be folded. In the case of a multi-layered container folding a flap without a fold line is not feasible.

FIGS. 2 and 3 illustrate a fold line 14 for a multi-layered container. The panel 11 is formed from single face corrugated board layers which are glued together to form a sleeve. A single faced corrugated board has a flat web which is liner board and a corrugated medium glued to the flat web at the tips of the corrugations. To form the fold line 14, a strip 20 of the corrugated medium for each single face corrugated board is left out or removed leaving only the liner board or flat web in the strip 20. This strip 20 represents a width W which is preferably at least as great as the caliper C representing the total thickness of the multi-layered panel or sleeve. As can be seen in FIG. 3, when the flap 13 is folded at a right angle, the strip 20 allows the fold line to collapse when folded.

If the container is made from a box blank wherein several layers are cut to the desired shape and then glued together in a flat configuration before bending into a container, the strip 20 may be made by arranging for no corrugations to be glued to the flat web in that area. Alternatively the corrugations may be cut on both sides of the strip from a full corrugated board and then peeled off or in some cases the corrugated material crushed or flattened so that it provides a fold line.

If the container is formed by winding a single face corrugated layer about a mandrel, then a strip of corrugated medium may be left off in the fold line when the corrugated board is made. Such an arrangement provides for segments of corrugated medium stuck to the flat web with one or more gaps left between the segments to form strips 20. In one embodiment an adhesive sheet may be used for a liner which avoids having to glue the corrugated medium to the sheet. Segments of corrugated medium with gaps between successive segments representing strips 20 may be positioned on the liner. Alternatively, the corrugated medium may be placed all over the adhesive liner, and the strips 20 cut out as desired. The adhesive sheet also acts as a moisture barrier.

If a strip 20 of corrugated medium is removed to form the fold line, it occurs before winding the single face corrugated layer about a mandrel in a manner that is disclosed hereafter. If the container is formed by winding about a mandrel, then before the flaps 13 can be folded, it is necessary to cut or sever each sleeve corner 12 so that the flaps 13 can be folded inwards. FIG. 4 illustrates a container 10 wherein slits 25 are cut at each corner 12 for the width of the flap and through the strip 20. The slits 25 shown herein do not remove material from the sleeve but simply allow each flap 13 to be folded inwards with the two horizontal flaps folded inwards first followed by the other two flaps. If desired, the two horizontal flaps may be removed leaving only two flaps 13 for the container 10.

If a flat box blank is made before forming a container, then one or more flaps may be pre-cut before the layers are assembled thus avoiding the necessity of cutting the multi-layered box blank after it has been assembled into a sleeve. Another method of cutting sleeve corners 12 is illustrated in FIGS. 5 to 8. A multi-layered container 10 is flattened in a first mode so that two opposing corners are folded into U-shaped configurations and the other two opposing corners are flat. The flattened container 10 is placed on a table 30 and held in the flattened position while two saw blades 31 cut through adjacent flaps 13 removing the opposing corners in the U-shaped configurations. The saw blades 31 cut through the flaps 13 and the strip 20. As shown in FIG. 6, the material removed by each saw cut forms a slot 33 which permits each flap 13 to be folded in about the fold line 12 without interferring with the adjacent flaps 13. The container 10 is then flattened in the other mode, and placed on the table 30. While in the flattened position, the saw blades are used to cut the two opposing corners 12 which have been folded into U-shaped configurations, to form two additional slots 33. As can be seen in FIG. 8, the container then has slots 33 at all four sleeve corners and all the flaps 13 can be folded inwards about the fold lines 14. The flaps 13 may extend for a quarter of the way across the ends of the container 10, in which case they are then generally called flanges. Short flaps or flanges may be attached by glueing, stitching or stapling to a bottom formed of multi-layered corrugated material or other suitable material. In another embodiment, the flaps 13 may extend half way across the container so when folded, they meet and close the container. This type of flap is called a full flap. Many styles of containers may be made having different widths of flap. In some cases, only two flaps are provided, and in the case of a multi-layered container made by winding corrugated board about a mandrel, two unwanted flaps are cut off, generally after the container has been made. Because the flaps have the same number of layers as the panel, increased strength is given to the ends of the container over the more conventional type of container which has fewer layers in the flaps.

Whereas a four sided container is illustrated herein, it will be apparent to those skilled in the art, that other shapes of containers having three or more sides may be formed. Polygonal shapes may be formed provided there is at least one straight side which has one flap attached thereto by a fold line. For example, a semi-circular container could be formed having a single flap with the fold line along the straight side representing the diameter of the semi-circular container.

One method of making a strip 20 representing a fold line for a container made by winding a multi-layered sleeve about a mandrel is illustrated in FIG. 9 wherein a single face corrugated layer 40 moves in a predetermined path prior to a glue applicator 41 and winding about a mandrel 42 to form a multi-layered container. The flat web liner board 15 is on the bottom and the corrugated medium 16 is on the top. The strip 20 is cut by means of two rotating fine tooth saws 44 rotating on a shaft 45. The saws 44 are spaced apart so that the width of the strip 20 can be determined. If a different width is to be cut, then the spacing between the two saws 44 is changed. The saws 44 cut through the corrugated medium 16 up to the liner board 15 but not through it. The cut corrugated medium 16 in the strip 20 is removed. The position of the strip 20 across the face of the corrugated layer 40 determines the height of the panel and the width of the flap.

As well as utilizing two saw blades 44, the strip 20 may be cut by means of a router which is arranged to cut out the corrugated medium 16 to the liner board 15. Other types of cutting devices, such as knives and other sharp edged devices may be used to cut the corrugated medium 16 away from the liner board 15 in the strip 20 and pull the cut corrugated medium 18 away from the liner board 15 so that when the single face corrugated board is wound on the mandrel, there are no corrugations left in the strip 20 thus allowing the fold line to be formed and the flap to be easily folded after construction of the container.

Various changes may be made to the embodiments shown herein regarding the corrugated container with the foldable flaps, and changes may also be made to the method of making this container without departing from the scope of the present invention which is limited only by the following claims.

The embodiments of the invention in which an exclusive property or privilege is claimed are defined as follows:

1. A container including a sleeve formed of a plurality of layers of a corrugated board, said corrugated board comprising a flat web and a corrugated medium, the sleeve having at least one flat side, and at least one flat on at least one end of the sleeve, the flap extending from the flat side of the sleeve, the sleeve having a fold line separating the flap from the flat side of the sleeve, the fold line comprising a strip defined by two substantially parallel cuts through the corrugated medium in each of the layers, the flat web in each of the plurality of layers being continuous and uncut across the strip, the corrugated medium positioned between the parallel cuts in each of the layers being flattened thereby permitting the flap to be bent about the fold line.

2. The container according to claim 1 wherein four flaps are provided on one end of the sleeve extending from four flat sides of the sleeve.

3. The container according to claim 1 wherein the strip with no corrugations therein is at least as wide as the thickness of the sleeve.

4. The container according to claim 3 wherein four flaps are provided on one end of the sleeve extending from four flat sides of the sleeve, and including a slit cut at each of the corners permitting all the flaps to be bent inwards about the fold lines.

5. The container according to claim 3 wherein four flaps are provided on one end of the sleeve extending from four flat sides of the sleeve and including a slot cut to remove sleeve material at each of the corners permitting all the flaps to be bent inwards about the fold lines.

6. In a container including a sleeve of a plurality of corrugated board layers, each layer comprising a flat web and a corrugated medium, the sleeve being formed by wrapping a corrugated board layer about a mandrel a plurality of times, the sleeve having at least four flat sides with corners between adjacent sides, and at least two flaps on at least one end of the sleeve, each flap extending from an opposing flat side, a fold line separating each flap from the side of the sleeve from which the flap extends, the fold line comprising a strip defined by two substantially parallel cuts through the corrugated medium, the web in the corrugated board of each of the plurality of layers being continuous and uncut across the strip, the corrugated medium positioned between the parallel cuts in each of the layers being flattened, and the flaps being cut at the sleeve corners allowing each flap to be bent inwards about its respective fold line.

7. A container including a sleeve formed of a plurality of layers of a corrugated board, said corrugated board comprising a flat web and a corrugated medium, the sleeve having at least one flat side, and at least one flap on at least one end of the sleeve, the flap extending from the flat side of the sleeve, the sleeve having a fold line separating the flap from the flat side of the sleeve, the fold line comprising a strip defined by two substantially parallel cuts through the corrugated medium in each of the layers, the flat web in each of the plurality of layers being continuous and uncut across the strip, the corrugated medium positioned between the parallel cuts in each of the layers being removed, thereby permitting the flap to be bent about the fold line.

8. In a container including a sleeve of a plurality of corrugated board layers, each layer comprising a flat web and a corrugated medium, the sleeve being formed by wrapping a corrugated board layer about a mandrel a plurality of times, the sleeve having at least four flat sides with corners between adjacent sides and, at least two flaps on at least one end of the sleeve, each flap extending from an opposing flat side, a fold line separating each flap from the side of the sleeve from which the flap extends, the fold line comprising a strip defined by two substantially parallel cuts through the corrugated medium, the web in the corrugated board of each of the plurality of layers being continuous and uncut across the strip, the corrugated medium positioned between the parallel cuts in each of the layers being removed, and the flaps being cut at the sleeve corners allowing each flap to be bent inwards about its respective fold line.

* * * * *

UNITED STATES PATENT AND TRADEMARK OFFICE

CERTIFICATE OF CORRECTION

PATENT NO. : 4,623,072

DATED : November 18, 1986

INVENTOR(S) : Achim R. Lorenz

It is certified that error appears in the above-identified patent and that said Letters Patent is hereby corrected as shown below:

At Column 5, line 45, "flat" should be "flap"

Signed and Sealed this

Twenty-fourth Day of February, 1987

*Attest:*

DONALD J. QUIGG

*Attesting Officer*

*Commissioner of Patents and Trademarks*